US006195845B1

(12) United States Patent
DuPont et al.

(10) Patent No.: US 6,195,845 B1
(45) Date of Patent: Mar. 6, 2001

(54) METHOD AND AN INSTALLATION FOR FORMING A FIBER WEB BY THE AIRLAY TECHNIQUE

(75) Inventors: Jean-Louis DuPont, Tourcoing; Xavier Catry; Marc Brabant, both of Hem, all of (FR)

(73) Assignee: Thibeau, Tourcoing (FR)

( * ) Notice: Subject to any disclaimer, the term of this patent is extended or adjusted under 35 U.S.C. 154(b) by 0 days.

(21) Appl. No.: 09/291,833

(22) Filed: Apr. 14, 1999

(30) Foreign Application Priority Data

Apr. 17, 1998 (FR) ..... 98 05050

(51) Int. Cl.[7] ..... D01G 25/00
(52) U.S. Cl. ..... 19/300; 19/98; 19/296
(58) Field of Search ..... 19/98, 99, 101, 19/106 R, 65 A, 115 R, 145.7, 161.1, 296, 300, 301, 302, 304, 151, 308

(56) References Cited

U.S. PATENT DOCUMENTS

| | | | | |
|---|---|---|---|---|
| 3,973,291 | * | 8/1976 | Kolbach | 19/301 |
| 4,130,915 | | 12/1978 | Gotchel et al. | 19/304 |
| 4,523,350 | * | 6/1985 | Schmiedgen et al. | 19/98 |
| 4,651,386 | * | 3/1987 | Frosch | 19/98 |
| 4,843,685 | * | 7/1989 | Vesa et al. | 19/98 |
| 4,931,005 | * | 6/1990 | Tanaka et al. | 19/296 |
| 5,226,214 | * | 7/1993 | Napolitano | 19/296 |
| 5,303,455 | * | 4/1994 | Leifeld | 19/105 |
| 5,517,726 | | 5/1996 | Beier | 19/296 |
| 5,584,101 | * | 12/1996 | Brabant et al. | 19/304 |
| 5,737,806 | * | 4/1998 | Leifeld et al. | 19/98 |

FOREIGN PATENT DOCUMENTS

| | | |
|---|---|---|
| 44 30 500 A1 | 2/1996 | (DE) . |
| 195 35 876 A1 | 4/1997 | (DE) . |
| 0 704 561 | 3/1983 | (EP) . |
| 0 093 585 B1 | 6/1989 | (EP) . |
| 0 378 807 A1 | 7/1990 | (EP) . |
| 1 473 987 | 6/1966 | (FR) . |
| 2 279 083 | 12/1994 | (GB) . |
| WO 96/06964 | 3/1996 | (WO) . |
| WO 97/20976 | 6/1997 | (WO) . |

OTHER PUBLICATIONS

European Search Report, No. EP 99 49 0010, Jul. 23, 1999.
France Search Report, No. FA 556375, FR 9805050, Dec. 16, 1998.
Patent Abstracts of Japan, vol. 016, No. 342 (C–0966), Jul. 24, 1994 & JP 04 100922 A (Iwamotoseisakushiyo:KK), Apr. 2, 1992.
Patent Abstracts of Japan, vol. 010, No. 310 (C–379), Oct. 22, 1986, JP 61 119724 A (Tshio Moro), Jun. 6, 1986.
Patent Abstracts of Japan, vol. 018, No. 401 (C–1231), Jul. 27, 1994 & JP 06 116853 A (Kurashiki Seni Kako KK), Apr. 26, 1994.

* cited by examiner

*Primary Examiner*—John J. Calvert
*Assistant Examiner*—Gary L. Welch
(74) *Attorney, Agent, or Firm*—Wolf, Greenfield & Sacks, P.C.

(57) ABSTRACT

A fiber web is formed by the airlay technique on a web forming and transport surface by dispersing and projecting individualized fibers onto said surface by means of a flow of air, and the fibers are subjected to a carding operation prior to being inserted into the flow of air. According to an essential characteristic of the invention, action is taken on the fiber feed rate by means of one or more regulator systems between the carding operation and the insertion of the fibers into the air flow so as to make said fiber feed rate more regular. In a preferred variant of the invention, a regulator system comprises at least a combing cylinder which is designed to be rotated to have a circumferential speed that is strictly less than that of the carding cylinder and that rotates in a direction of rotation that is opposite to that of the carding cylinder, and that is coated on its periphery with a covering whose teeth or spikes point backwards, i.e. in the opposite direction to its direction of rotation.

31 Claims, 3 Drawing Sheets

METHOD AND AN INSTALLATION FOR FORMING A FIBER WEB BY THE AIRLAY TECHNIQUE

The present invention relates to the field of manufacturing a fiber web by the airlay technique. More precisely, the invention relates to a method of forming a fiber web by dispersing and projecting individualized fibers by means of a flow of air onto a surface for forming and transporting the web, the fibers also having previously been carded. The invention also relates to an installation for implementing the method.

BACKGROUND OF THE INVENTION

The so-called "airlay" technique has been known for many years for forming a fiber web. That technique is characterized by individualized fibers being dispersed and projected by means of a flow of air onto an air-permeable surface which enables the fiber web to be formed and transported. The individualized fibers are subjected to random dispersion as they travel in the air flow, thereby contributing to obtaining a fiber web having mechanical properties with improved isotropy.

When implementing the airlay technique, the degree of fiber opening plays a preponderant role in determining the uniformity of the resulting web. It will be understood that the greater the extent to which the fibers are individualized prior to being injected into the air flow, the smaller the risk that the final fiber web will have residues or clumps of fibers stuck together, which give rise to visible localized marks in the web, which spoil the uniformity thereof.

To prepare the fibers prior to injection into the airlay air flow, it has been known for many years to perform a carding operation on the fibers upstream from said air flow. The carding operation is generally implemented by means of a carding system having at least one carding cylinder at its outlet, which cylinder is fitted on its periphery with combing means serving to individualize the fibers and cause them to extend substantially parallel to one another on the periphery of the carding cylinder. By way of non-limiting example, the combing means can be constituted in conventional manner by a working roll associated with a stripping roll, or more usually by a plurality of successive pairs of those two types of roll. The combing means can also be in the form of a fixed housing having a plurality of carding spikes, commonly known as a carding plate. At the outlet from the combing means disposed at the periphery of the carding cylinder, fibers are obtained which are pressed against the surface of the carding cylinder and which are individualized and which extend substantially parallel to one another in the longitudinal direction corresponding to the direction in which the material is advancing.

In a first known method that combines upstream fiber carding with the web-forming airlay technique, an airlay air flow is established to disperse and project the fibers in such a manner that the air flow is oriented substantially tangentially to the last carding cylinder of the carding system and comes into contact with the surface of the cylinder. That first method is already described in numerous publications and corresponds, for example, to the solutions proposed in European patent application EP-A-0 093 585 (CHICOPEE) or in international patent application WO96/06964 (HERGETH HOLLINGSWORTH GMBH). In that first method, the fibers are detached from the carding cylinder both under the effect of the air flow and under the effect of centrifugal force, it being understood that in order to implement the fiber carding functions, the last carding cylinder rotates at high speed. The air flow thus performs two functions: it assists in detaching the fibers from the surface of the carding cylinder; and it directs the fibers, reorienting them in random manner on a remote air-permeable collecting surface for forming and transporting the fiber web. In the particular variant of international patent application WO96/06964, fiber dispersion is further improved by the presence of an additional rotary cylinder (referenced 20 in the figures of application WO96/06964) driven at high speed in the opposite direction to the last carding cylinder (referenced 8 in the figures of application WO96/06964), and placed on the trajectory of the fibers in the air flow.

Proposals have also been made in international patent application WO97/20976 (E.I. DUPONT DE NEMOURS AND COMPANY) for a second method that combines upstream carding of fibers with the airlay web-forming technique. That method is characterized by implementing a disperser rotary cylinder between the last carding cylinder of the carding system and the airlay air flow, which disperser cylinder is driven at high speed and serves to eject the fibers into the airlay air flow under the effect of centrifugal force. In that second method, the fibers are detached from the periphery of the disperser cylinder solely under the effect of centrifugal force without any assistance from the airlay air flow. In a first variant shown in FIG. 1 of that publication, the disperser cylinder (reference 50) takes up the fibers directly from the periphery of the carding cylinder (referenced 40). In another variant, shown in FIG. 3 of that publication, a transfer cylinder referenced (48) is interposed between the disperser cylinder (50) and the carding cylinder (40), with the transfer cylinder commonly being referred to as a "communicator". This cylinder serves merely to take up the fibers from the periphery of the last carding cylinder and to transfer them unchanged to the disperser cylinder, without causing them to be subjected to any kind of transformation, and in particular without altering their parallel orientation.

The first and second above-mentioned methods are advantageous in that they make it possible to obtain fibers with a satisfactory degree of opening by suitably adjusting the action of the carding members, where such adjustment is these days thoroughly mastered. However, in practice, it is found that obtaining a large degree of fiber opening is not sufficient on its own to obtain a uniform fiber web, and that the most important factor affecting the quality of the fiber web lies in the random dispersion of the fibers by the airlay air flow on the surface where the web is formed and transported. The parameters affecting said random dispersion are numerous and at present they are poorly mastered. These parameters include in particular the nature and the length of the fibers, the speed, the width, and the orientation of the airlay air flow, and the speed of rotation of the last cylinder (carding cylinder for publications EP-A-0 093 585 and WO96/06964; disperser cylinder for publication WO97/20976). Adjusting parameters that affect random dispersion of the fibers is thus extremely difficult, and in practice it can only be done experimentally and for any one given type of fiber, by performing successive tests and monitoring the uniformity of the resulting web. Apart from the above-mentioned drawback which is common to the first and second methods, and which is associated with the preponderance of the random dispersion of the fibers under the action of the airlay air flow in obtaining a web that is uniform, the first method also has the drawback of requiring an airlay air flow that is very powerful to enable the fibers to be detached, since in practice they are tightly held to the last carding cylinder. Unfortunately, implementing a powerful air flow gives rise to turbulence which is difficult to master and which spoils the uniformity of the resulting fiber web, in particular by causing fibers to group together preferentially in the form of clumps.

When implementing the second method, the airlay air flow does not serve to detach fibers from the periphery of a cylinder, in this case the disperser cylinder, so the flow can advantageously be weaker than that used in the first above-mentioned method. However, this is at the cost of the need to drive a cylinder (the disperser cylinder) at very high speed, which is expensive in terms of energy consumption, and is more difficult to achieve mechanically speaking, particularly because of vibratory phenomena which may be generated on the cylinder. In addition, the second method recommended in international patent application WO97/20976 also suffers from an additional drawback associated with selecting the peripheral covering of the disperser cylinder. The peripheral covering of the disperser cylinder needs to satisfy two contradictory constraints. Firstly it must be sufficiently aggressive to enable it to take up fibers effectively from the periphery of the upstream cylinder (carding cylinder in the first variant, or "communicator" cylinder in the second variant), thereby avoiding harmful clogging of the upstream cylinder, while also being sufficiently unaggressive to enable the fibers to be ejected under centrifugal force and to avoid fibers being retained on the periphery of the disperser cylinder. It is therefore necessary to select an opening angle and a density per unit area for the teeth of the covering on the disperser cylinder that make it possible to achieve a compromise between those two contradictory constraints. As a result selecting a covering for the disperser cylinder is very difficult and the range is limited.

SUMMARY OF THE INVENTION

The present invention proposes a novel method of forming a fiber web which is similar to the first and second methods described above in that it combines an airlay technique of forming a fiber web with upstream preparation of the fibers by carding, but which has the advantage over those two known methods of making the random dispersion of the fibers under the action of the airlay air flow less preponderant in obtaining a uniform fiber web.

The method of the invention is known in particular from either of the above-mentioned publications in so far as a fiber web is formed on a web forming and transporting surface by dispersing and projecting individualized fibers onto said surface by means of a flow of air, and in so far as the fibers are subjected to a carding operation prior to be inserted into the air flow.

According to an essential characteristic of the method of the invention, action is taken on the fiber feed rate between the carding operation and insertion of the fibers into the air flow, with the action being taken by means of one or more regulators so as to cause said fiber feed rate to be more regular.

In the first and second prior art methods, the fibers coming from the last carding cylinder are highly individualized and they are oriented substantially parallel to one another because of the carding action to which they have been subjected; they form what is commonly known as a "parallel" web which presents very low cohesion in the transverse direction. However, it is observed in practice that this carding action ends up by producing a fiber web that is highly irregular and non-uniform, even when the rate at which material is fed to the inlet of the card is constant. This can be explained by the fact firstly that the fibers being carded are highly stressed, thereby causing "holes" to appear in the parallel web produced by the carding, and secondly by the fact that the fibers have a travel time through the carding system that is longer or shorter depending mainly on fiber length; shorter fibers are carded more quickly while longer fibers tend comparatively to be retained for a longer length of time in the carding members. Thus, in the first and second prior art methods, the rate at which fibers are inserted into the airlay air flow is completely irregular, and according to the Applicant that can explain why the random dispersion action of the airlay air flow on the fibers is preponderant in obtaining a uniform fiber web. In contrast, in the method of the invention, by feeding the airlay air flow with fibers at a more regular rate, the random dispersion of the fibers by the airlay air flow is, advantageously, made less preponderant in obtaining a uniform fiber web. In the method of the invention, it is also advantageous to act on the uniformity and consequently on the isotropy of the airlay fiber web obtained on the forming and transport surface by acting directly on the feed rate of parallel web fibers coming from the carding, since that turns out to be easier.

In a preferred implementation of the method of the invention, firstly to perform the carding operation on the fibers, a carding system is implemented which is designed to be fed with fiber material and which includes at its outlet a carding cylinder fitted on its periphery with means having the function of individualizing and orienting the fibers situated on the periphery of the carding cylinder substantially parallel to one another, and secondly to make the flow rate of fibers from the carding cylinder more regular, at least one first combing cylinder is implemented which is disposed at the periphery of the carding cylinder, which is designed to be rotated at a circumferential speed that is strictly less than that of the carding cylinder and in the direction of rotation opposite to that of the carding cylinder, and that is coated on its periphery with a covering whose teeth or spikes point backwards, i.e. in the opposite direction to its direction of rotation. In this variant, the combing cylinder acts as a barrage that regulates the fibers coming from the carding cylinder by ensuring that only a portion of the fibers are taken up at the periphery of the carding cylinder and by regulating the fiber feed rate. The speed of rotation of the combing cylinder is set at a function of the fiber feed rate desired at the outlet from said cylinder.

The invention also provides an installation for implementing the above-mentioned method. The installation is known, in particular from international patent application WO97/20976, in so far as it implements:

- a carding system which is designed to be fed with fiber material and which has at its outlet a carding cylinder fitted on its periphery with means having the functions of individualizing the fibers situated on the periphery of the carding cylinder and of orienting them substantially parallel to one another;
- a surface for forming and transporting the fiber web, which surface is associated with means for forming a flow of air; and
- means for taking up all or some of the fibers situated at the periphery of the carding cylinder and inserting them into the air flow, the function of the air flow being to disperse the fibers and project them onto the forming and transport surface.

In a manner that is characteristic of the invention, the means for taking up and inserting fibers into the air flow comprise:

- at least one regulator system having the function of taking up a portion only of the fibers individualized at the periphery of the carding cylinder and designed to output fibers at a more regular rate; and a rotary outlet cylinder having the function of taking up the fibers from the regulator system and bringing them into the air flow.

BRIEF DESCRIPTION OF THE DRAWINGS

Other characteristics and advantages of the invention appear more clearly on reading the following description of two particular embodiments of the invention, which description is given by way of non-limiting example and with reference to the accompanying drawings, in which.

MORE DETAILED DESCRIPTION

Figure 1:
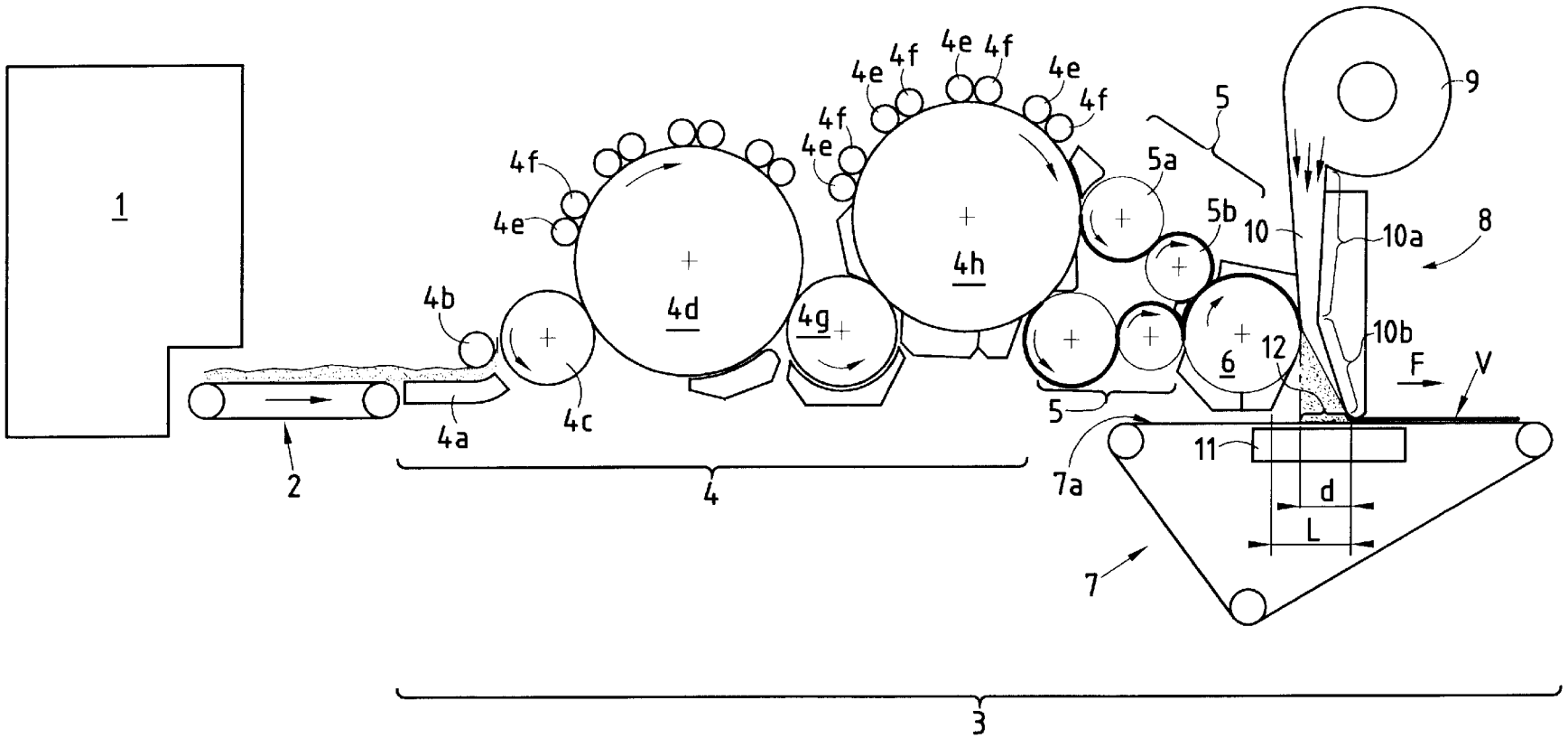
FIG. 1 is a diagram of a fiber web production line using the airlay technique, and implementing an installation of the invention constituting a first variant embodiment.

The fiber web production line shown in FIG. 1 comprises a traditional weighing hopper feeder 1 which feeds an installation 3 via a conveyor 2. The installation 3 is made in accordance with the invention and serves to form a fiber web V at its outlet by using the airlay technique.

In the particular example of FIG. 1, the installation 3 is constituted by:

a card 4;

two regulator systems 5 delivering two condensed webs in parallel;

an outlet cylinder 6 for taking up the two condensed webs as delivered in parallel by the two regulator systems 5;

a conveyor 7 having a belt that is permeable to air and designed to be driven in the direction of arrow F, at a preferably adjustable linear speed and having a top rectilinear portion 7*a* that acts as a surface for forming and transporting the fiber web V; and means 8 for creating an airlay air flow and oriented transversely towards the top rectilinear portion 7*a* of the belt of the conveyor 7.

The structure and the operation of the card 4 are traditional and are therefore not explained in detail. In FIG. 1, the card 3 has a card inlet constituted by a trough 4*a,* a feed roll 4*b*and a taker-in cylinder 4*c*. The taker-in cylinder 4*c* feeds a first rotary carding cylinder 4*d* commonly referred to as a "breast", and whose surface is coated in conventional manner with a card covering or any other equivalent means enabling it to take up fibers from the periphery of the taker-in cylinder 4*c*. In conventional manner, the carding cylinder 4*d* is also provided on its periphery with combing means for working the fibers taken in the card covering of the cylinder, so as to individualize them and put them in parallel. In the particular example shown, the combing means are constituted by a plurality of successive pairs comprising a stripper roll 4*e* and a worker roll 4*f*. Downstream from these combing means, the fibers are taken up from the periphery of the first carding cylinder 4*d* and transferred unchanged to a second rotary carding cylinder 4*h* via a transfer cylinder 4*g* also known as a "communicator". The second carding cylinder, also commonly referred to as a "big drum" or "main drum" is also covered in a carding covering or the like enabling it to take up fibers from the periphery of the communicator 4*g*, and it is provided on its periphery with combing means (4*e,* 4*f*) identical to those fitted to the periphery of the first carding cylinder 4*d.*

The invention is not limited to a method or an installation implementing a card having the particular configuration of the card 4 described above with reference to FIG. 1. In particular, as a function of the type of fiber to be opened and of the degree of opening desired for the fibers, it is possible to envisage using a longer card implementing at least three successive carding cylinders, or on the contrary a shorter card implementing a single carding cylinder. In addition, the rolls 4*e* and 4*f* could be disposed so as to be juxtaposed one behind another in alternating manner in a configuration commonly known under the name "Garnett". The stripper and worker rolls (4*e,* 4*f*) at the periphery of each carding cylinder could also be replaced by any means of different structure that perform the same function, i.e. that co-operate with the carding cylinder to individualize the fibers on the periphery of the carding cylinder and to make them parallel. In particular, these rolls could be replaced by static plates commonly referred to as "carding plates" mounted at the periphery of the carding cylinder and including a plurality of carding spikes in the form of grooves or fluting, for example. For the reasons mentioned above, the invention consequently applies to any method and to any installation for forming a fiber web by the airlay technique and, in general terms, implementing at least one rotary carding cylinder fitted at its periphery with means that serve to individualize the fibers on the periphery of the carding cylinder and to orient them substantially parallel to one another.

In the particular example of FIG. 1, each regulator system 5 is constituted by two successive cylinders 5*a* and 5*b*. The first cylinder 5*a* is of the combing cylinder type, is disposed at the periphery of the second carding cylinder 4*h,* and is designed to be rotated so that it has a circumferential speed that is strictly less than that of the carding cylinder 4*h,* and in a direction of rotation that is opposite to that of the second carding cylinder 4*h*. The cylinder 5*a* is coated on its periphery with a covering that has a multitude of spikes enabling fibers to be taken up from the periphery of the carding cylinder 4*h*. If reference is made to FIG. 3, it can be seen that these spikes which are referenced 5'*a* point backwards, i.e. they point in the opposite direction to the direction of rotation of the cylinder 5*a* and form an angle A relative to the tangent with the cylinder 5*a* such that A is greater than or equal to 90°. These spikes can be replaced by any equivalent means, and in particular by teeth or the like pointing in the same direction. The second cylinder 5*b* is disposed at the periphery of the first cylinder 5*a* and is designed to be rotated so that it has a circumferential speed that is less than or equal to that of the first cylinder 5*a*. In the example of FIG. 1, the cylinder 5*b* is designed to be rotated in the opposite direction to the first cylinder 5*a;* in this case, the cylinder 5*b* is coated on its periphery with a covering having a multitude of teeth or spikes 5'*b* which point backwards, i.e., with reference to FIG. 3, which point in the direction opposite to the direction of rotation of the cylinder 5*b* and which form an angle B relative to the tangent of the cylinder 5*b,* where B is greater than or equal to 90°.

Figure 3:
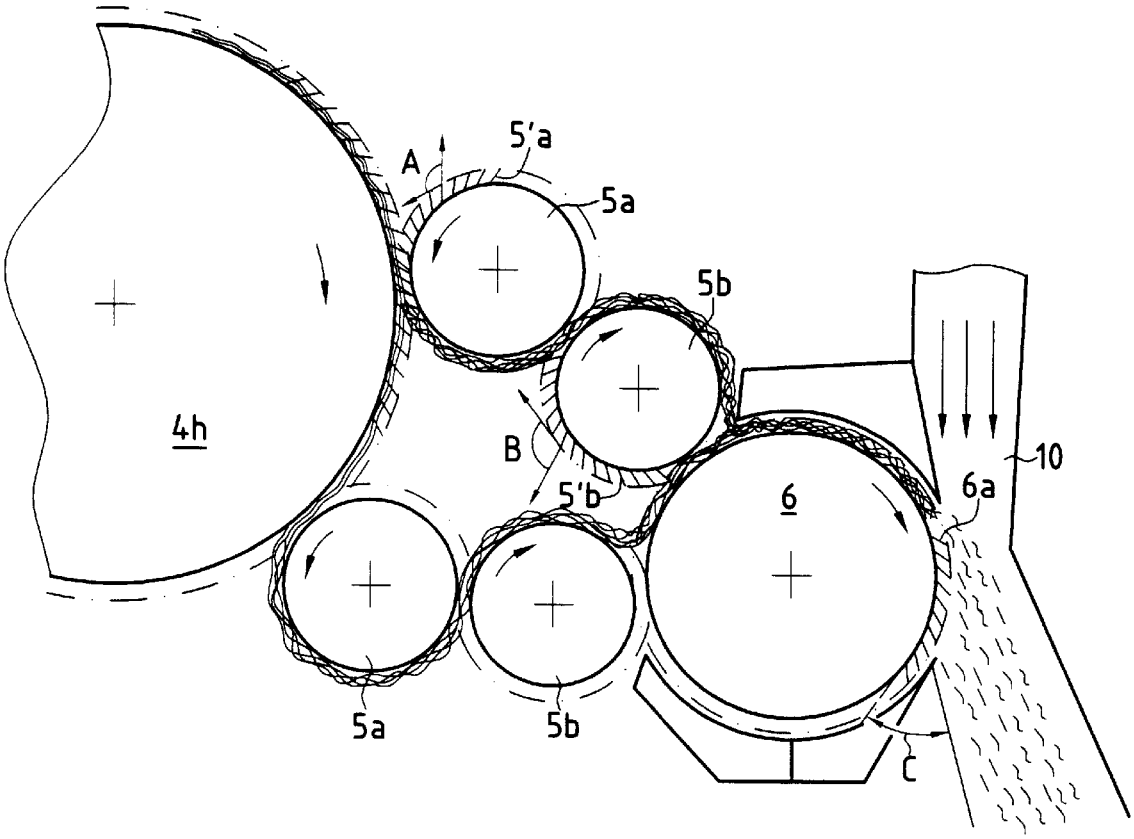
FIG. 3 shows more precisely the cylinders of the regulator systems and the outlet cylinder of the FIG. 1 production line, and in particular it shows the directions in which the spikes point on the respective coverings of said cylinders.

The cylinders 5*b* of each of the regulator systems 5 are disposed at the periphery of the single outlet cylinder 6. The outlet cylinder 6 is designed to be rotated with a circumferential speed that is greater than or equal to the circumferential speed of each of the cylinders 5*b,* and in the same direction of rotation. With reference to FIG. 3, the cylinder 6 is provided on its periphery with a covering in which the spikes 6*a* or teeth point forwards with an opening angle C that is less than or equal to 90°.

The means 8 for forming the airlay air flow mainly comprise a fan 9 whose outlet is connected to a blow channel 10 pointing substantially transversely to the surface 7*a* on which the fiber web V is formed and transported. In the particular example of FIG. 1, the blow channel 10 is constituted by a top portion 10*a* of slightly tapering section extending from the outlet of the fan 9 to the periphery of the outlet cylinder 6, and a bottom portion 10*b* which extends the top portion 10*a* from the periphery of the outlet cylinder 6. This bottom portion 10*b* is at a section that flares going away from the periphery of the outlet cylinder 6 and it extends to the proximity of the surface 7*a* on which the fiber web V is formed and transported. At its end remote from the fan 9, there is mounted a suction box 11 which extends preferably at least over the entire width L of the outlet section of the bottom portion 10*b* of the blow channel 10, with the surface 7*a* on which the web V is formed and transported being interposed between said suction box 11 and the outlet of the blow channel 10. In the example of FIG. 1, the suction box 11 extends well beyond the outlet from the blow channel 10 so as to enable the fiber web V to be held securely to the surface 7*a* while it is being transported.

In operation, the second cylinder 5*b* of each regulator system 5 is rotated to have a circumferential speed which is less than or equal to that of the first cylinder 5*a,* and the cylinder 5*a* is rotated to have a circumferential speed which is strictly less than that of the second carding cylinder 4*h*. The outlet cylinder 6 is rotated at a circumferential speed which is greater than or equal to that of the second cylinders 5*b* in each of the regulator systems 5.

At the periphery of the second carding cylinder 4*h,* downstream from the combing means (4*e,* 4*f*), a very light fiber web is obtained commonly known as a "parallel" web, in which the fibers are highly individualized and oriented substantially parallel to one another in the machine direction, i.e. along the circumference of the carding cylinder 4*h*. The web has very little mechanical strength in the transverse direction and, in practice, it is pressed against the periphery of the carding cylinder 4*h,* being positioned in the bottom of the peripheral covering of said cylinder (FIG. 3). Given the respective circumferential speeds of the cylinders 4*h,* 5*a,* 5*b,* and 6, and given the directions in which the spikes or teeth of their coverings point, the fibers constituting the parallel web disposed at the periphery of the second carding cylinder 4*h* are subjected to the following treatments. The first cylinder 5*a* of the top regulator system 5 takes up only a fraction of these fibers, and reorients them, so that they are no longer parallel. This first cylinder 5*a* is the main regulator member which serves essentially to act on the fiber feed rate so as to make this fiber feed rate more regular. The reoriented web from the first cylinder is thus more uniform than the parallel web from the periphery of the carding cylinder 4*h*. All of the fibers in this web are taken up from the periphery of the first cylinder 5*a* by the second cylinder 5*b* which has the effect of lifting the fibers and thus of condensing and entangling the web even more. As can be seen diagrammatically in FIG. 3, the second cylinder 5*b* stores a large quantity of fibers in its peripheral covering. In parallel, the cylinders 5*a* and 5*b* of the bottom regulator system 5 perform the same operations on the residual fibers at the periphery of the carding cylinder 4*h* that were not taken up by the top regulator system 5. At the outlet from the two regulator systems 5, two condensed webs are obtained in parallel which are disposed at the respective peripheries of the second cylinders 5*b*. These two condensed webs are taken up by the outlet cylinder 6 to be conveyed in the form of a single condensed web into the blow channel 10 where the airlay air flow is created.

In the contact zone between the airlay air flow and the periphery of the outlet cylinder 6, the fibers of the condensed web at the periphery of the outlet cylinder 6 are detached from the cylinder, are dispersed in random manner within the blow channel 10, and are projected individually onto the surface 7*a* of the conveyor, distributing themselves over a zone 12 in which the fiber web V is formed, and with reference to FIG. 1, it can be seen that this zone extends over a distance d in the forward direction of the conveyor belt. At the outlet from the zone 12, an airlay fiber web V is obtained in which the fibers are reoriented in all three directions, i.e. in directions which are longitudinal and transverse relative to the surface 7*a* of the conveyor, and also in the direction perpendicular to the plane of said surface 7*a* (thickness of the web V). This web is more uniform and more isotropic than is the parallel web from the second carding cylinder 4*h*. The density and the thickness of the fiber web V depend on the linear speed of the surface 7*a,* i.e. on the linear speed of the conveyor 7.

In the particular variant installation shown in FIG. 1, fibers are detached from the periphery of the outlet cylinder 6 by the combined effects of the airlay air flow which comes into contact with the periphery of the cylinder, and of centrifugal force as imparted to the fibers because of the rotation of the outlet cylinder 6. The airlay air flow is preferably created relative to the outlet cylinder 6 in such a manner that it penetrates into the covering of the cylinder so as to maximize the efficiency with which the fibers are detached. The fibers also detach more easily when the airlay air flow is in a direction that is substantially tangential to the periphery of the outlet cylinder 6, and the teeth or spikes 6*a* of the covering on said outlet cylinder 6 are pointed in the same direction as said airlay air flow. In this variant, the speed of the airlay air flow in the blow channel 10 at the outlet cylinder 6 is preferably greater than or equal to the circumferential speed of the outlet cylinder 6 so that the air flow provides maximum assistance in detaching the fibers. It is up to the person skilled in the art to determine the air flow rate required from the fan 9, as a function of the circumferential speed of the cylinder 6 and of the volume and section of the blow channel 10 to obtain the required air speed.

In another variant embodiment, it is possible to envisage implementing an outlet cylinder 6 which is driven at a speed of rotation that is high enough for the fibers to be detached from the periphery of the cylinder solely under the effect of centrifugal force. In which case, the air speed in the blow channel 10 at the outlet cylinder 6 can be lower than the circumferential speed of the outlet cylinder 6. In addition, in this other variant, there is no need for the airlay air flow to pass through the covering of the outlet cylinder 6; the airlay air flow can be established so that it merely "licks" over the ends of the spikes or teeth of the covering of the outlet cylinder 6. In the limit, with sufficient circumferential speed, it is possible to envisage the airlay air flow making no contact with the covering of the outlet cylinder, but being at a small distance from the periphery of said covering.

In a particular embodiment of the invention given purely by way of non-limiting indication, the manufacturing line of FIG. 1 has been designed to produce a fiber web from polyester fibers having a titre of 1.7 dtex and an average length of about 38 mm. The diameter of the second carding cylinder 4*h* was 900 mm, and said cylinder was rotated at a speed of about 1500 meters per minute (m/min); the diameter of the combing or first cylinder 5*a* of each regulator system 5 was 500 mm, and the cylinder was rotated at a speed of about 300 m/min; the covering of each first cylinder 5*a* had a density of spikes (or teeth) of about 46 spikes/cm$^2$, and the opening angle A of said spikes or teeth was about 140°; the diameter of the condenser or second cylinder 5*b* of each regulator system 5 was 350 mm and the cylinder was rotated at a speed of about 150 m/min; the covering of each second cylinder 5*a* had a density of spikes (or teeth) of about 23 spikes/cm$^2$ and the opening angle B of said spikes or teeth was about 140°; the diameter of the outlet cylinder 6 was 500 mm, and said cylinder was rotated at a speed lying in the range 500 m/min and 3000 m/min; and the covering of said outlet cylinder 6 had a density of spikes (or teeth) lying in the range about 23 to 31 spikes/cm$^2$, and the opening angle C of said points or teeth was about 90°.

The installation of the invention as described above with reference to FIGS. 1 to 3 has various advantages. The main advantage stems from implementing at least one regulator system 5 between the outlet from the card 4 and the airlay air flow, with the regulator system advantageously making it possible to feed the blow channel 10 with fibers at a rate that is firstly more regular than the rate at which fibers are fed from the outlet of the card 4, and which secondly can be adjusted, mainly by acting on the speeds of rotation of the combing cylinders 5*a* of the regulator systems 5. It is thus possible, in particular by acting on the speeds of rotation of the combing cylinders 5*a* of the regulator systems 5 to modify the uniformity and the isotropy of the fiber web V obtained at the outlet, and incidentally to improve the uniformity and the isotropy of said web. In comparison, in prior art solutions, it has always been the objective to make the airlay air flow act directly on the parallel web coming from the card. For example, in European patent application EP-A-0 093 585 (CHICOPEE) or in international patent application WO96/06964 (HERGETH HOLLINGSWORTH GMBH), the airlay air flow acts directly on the last carding cylinder which is equivalent to the second carding cylinder 4*h* in the installation of FIG. 1. In international patent application WO97/20976 (E.I. DUPONT DE NEMOUS AND COMPANY), the airlay air flow acts on the fibers coming from the periphery of a disperser cylinder disposed downstream from the card outlet; nevertheless, in that publication, the parallel orientation of the fibers while they are being transferred from the outlet of the card to said disperser cylinder is not modified. As a result, in those prior art solutions, it is essentially the random effect of fiber dispersion in the airlay air flow that determines the uniformity and the isotropy of the resulting fiber web, and this random dispersion effect must also be more effective given that the rate at which fibers are fed to the inlet of the blow channel in prior art solutions is highly irregular. In the solution of the invention, the random dispersion effect on the fibers in the airlay air flow continues to perform a role in obtaining uniformity and isotropy in the resulting fiber web V; however this effect is less preponderant than in prior art solutions, and it becomes easier to act on the uniformity and the isotropy of the web V, thus making it easier to improve the uniformity and the isotropy of said web, by appropriately adjusting the fiber feed rate to the means of the regulator systems.

Another advantage of the invention lies in the greater ease with which the web condensed on the periphery of the outlet cylinder 6 can be detached compared with prior art solutions. Thus, when the airlay air flow assists in detaching the fibers from the periphery of the outlet cylinder 6, it is possible to use an air flow that is less powerful, e.g. compared with the solutions of publications EP-A-0 093 585 (CHICOPEE) and WO96/06964 (HERGETH HOLLINGSWORTH GMBH); when fibers are detached from the periphery of the outlet cylinder under the effect solely of centrifugal force, it is advantageously possible to obtain fiber detachment at a lower circumferential speed of the outlet cylinder compared, for example, with the circumferential speed necessary for the disperser cylinder of the solution described in publication WO97/20976 (E.I. DUPONT DE NEMOURS AND COMPANY).

An additional advantage of the solution of the invention, compared for example with the solution recommended in the publication WO97/20976 (E.I. DUPONT DE NEMOURS AND COMPANY) lies in the possibility of opting for a covering for the outlet cylinder that is not very aggressive (lower density of teeth or spikes on the covering, and said teeth or spikes having a larger opening angle relative to the tangent of the cylinder), and in particular that is less aggressive than the covering which must be used for the disperser cylinder of publication WO97/20976. This is explained by the fact the condensed web is taken up from the outlet of each regulator system 5 very easily, given that the fibers of the web have been rectified and are not localized in the bottom of the covering of said cylinder, unlike, for example, the fibers situated at the periphery of the carding cylinder 4*h*. The ability to implement a covering that is not very aggressive advantageously contributes to making it easier to detach the fibers from the periphery of the outlet cylinder 6.

Figure 2:
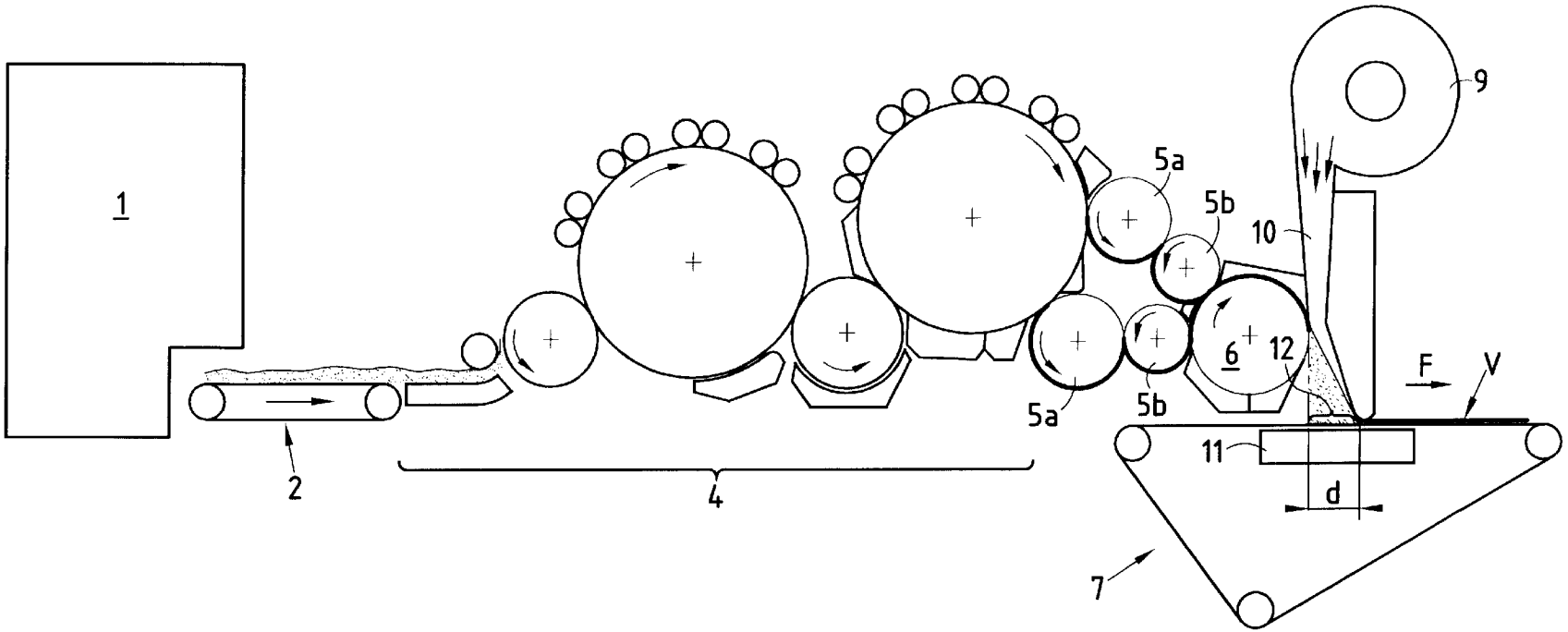
FIG. 2 is a diagram of a fiber web production line using the airlay technique, and implementing an installation of the invention constituting a second variant embodiment.

The line for manufacturing a fiber web by the airlay technique of FIG. 2 differs from that of FIG. 1 solely in the direction of rotation of the second cylinder 5*b* of each regulator system 5. The direction of rotation is reversed compared with the direction of rotation of the outlet cylinder 6. As a result, the teeth or spikes on each second cylinder 5*b* no longer point backwards as in the FIG. 1 variant, but point forwards. For this reason, in order to enable fibers to be taken up by the outlet cylinder 6, it is necessary in this variant for the circumferential speed of the outlet cylinder 6 to be strictly greater than that of the second cylinder 5*b*. The variant of FIG. 2 has all of the advantages of the variant of FIG. 1, and also presents the additional advantage of preventing the condensed web being pushed back as it passes between the second cylinder 5*b* and the outlet cylinder 6.

The invention is not limited to the particular embodiments of FIGS. 1 and 2. In particular, it can be envisaged to implement more than two regulator systems 5 in parallel, distributing them over the periphery of the carding cylinder 4*h;* the structure of a regulator system is not limited to implementing two successive cylinders 5*a* and 5*b;* in particular, it is possible to implement a regulator system constituted solely by one or more combing cylinders 5*a* without having any condenser cylinder; in general, it is possible to replace the two cylinders 5*a* and 5*b* with any structure that performs the same function, i.e. that takes up a portion only of the fibers on the periphery of the carding cylinder 4*h* and that enables the regularity of the fiber feed rate to be improved prior to the fibers being dispersed by the airlay air flow. In another variant, it can be envisaged to provide an additional cylinder, commonly referred to as a drum backing cylinder that is disposed tangentially both to the carding cylinder 4*h* and to the first combing cylinder 5*a* and that is rotated in the same direction as the carding cylinder, thus having the opposite direction of rotation to the combing cylinder 5*a*. It is also possible to envisage omitting the outlet cylinder 6, in particular when the installation has a single regulator system only, and to cause the airlay air flow to act directly on the condensed web at the outlet from the second cylinder 5*b* in each regulator system 5.

What is claimed is:

1. An installation for forming a fiber web by an airlay technique, the installation comprising:

a carding system which is designed to be fed with fiber material and which has at its outlet a carding cylinder fitted on its periphery with means having the functions of individualizing fibers of the fiber material situated on the periphery of the carding cylinder and of orienting them substantially parallel to one another;

a surface for forming and transporting the fiber web, which surface is associated with means for forming a flow of air; and means for taking up at least some of the fibers situated at the periphery of the carding cylinder and inserting them into the flow of air, the function of the flow of air being to disperse the fibers and project them onto the forming and transports surface;

wherein the means for taking up the fibers and inserting them into the flow of air comprise:

at least one regulator system comprising a combing cylinder which is disposed at a periphery of the carding cylinder, the combing cylinder being designed to be rotated at a circumferential speed that is strictly less than a circumferential speed of the carding cylinder and to be rotated in a direction of rotation opposite to a direction of rotation of the carding cylinder, and which is coated on its periphery with a covering having spikes pointing in the direction opposite to the direction of rotation of the combing cylinder; and a rotary outlet cylinder having the function of taking up the fibers from the at least one regulator system and bringing the fibers into the flow of air.

2. The installation according to claim 1, wherein said at least one regulator system further includes a condenser cylinder disposed at a periphery of the combing cylinder, the condenser cylinder being designed to be rotated at a circumferential speed that is not greater than the circumferential speed of the combing cylinder.

3. The installation according to claim 2, wherein the condenser cylinder is designed to be rotated in a direction opposite to the direction of rotation of the combing cylinder and is coated on its periphery with a covering whose spikes point in the direction opposite to the direction of rotation of the condenser cylinder.

4. The installation according to claim 3, wherein the outlet cylinder is disposed at the periphery of the condenser cylinder of the regulator system, and is designed to be rotated to have a circumferential speed that is not smaller than the circumferential speed of the condenser cylinder and in the same direction of rotation as the condenser cylinder, and is coated on its periphery with a covering whose spikes point in the same direction as the direction of rotation of the outlet cylinder.

5. The installation according to claim 2, wherein the condenser cylinder is designed to be rotated in the same direction of rotation as the combing cylinder, and is coated on its periphery with a covering whose spikes point in the same direction as the direction of rotation of the condenser cylinder.

6. The installation according to claim 5, wherein the outlet cylinder is disposed at the periphery of the condenser cylinder of the regulator system, and is designed to be rotated to have a circumferential speed that is strictly greater than the circumferential speed of the condenser cylinder and in the direction of rotation opposite to that of the condenser cylinder, and is provided at its periphery with a covering whose spikes point in the same direction as the direction of rotation of the outlet cylinder.

7. The installation according to claim 2, wherein the condenser cylinder is designed to be rotated at a circumferential speed that is less than the circumferential speed of the combing cylinder.

8. The installation according to claim 1 comprising at least two regulator systems arranged in parallel.

9. The installation according to claim 1 wherein the outlet cylinder is designed to be rotated at a circumferential speed that is strictly greater than the circumferential speeds of the carding cylinder, the combing cylinder, and the condensing cylinder and is high enough for the fibers to become detached from the periphery of the outlet cylinder solely by a centrifugal force.

10. The installation according to claim 1, further comprising a blow channel for directing the flow of air and containing the fibers in the flow of air.

11. An installation for forming a fiber web by an airlay technique, the installation comprising:

a carding system constructed to receive a fiber material and comprising a carding cylinder, rotating at a first circumferential speed, co-operatively arranged with a mechanism disposed at a periphery of the carding cylinder and constructed to individualize the fibers and orient the fibers substantially parallel to one another to form a parallel web of fibers;

a regulator system including a first regulator cylinder co-operatively arranged with the carding cylinder to take up at least some of the parallel web fibers situated at the periphery of the carding cylinder, the first regulator cylinder being arranged to rotate at a second circumferential speed that is smaller than the first circumferential speed of the carding cylinder, the regulator system being constructed to reorient the fibers of the parallel web, control a rate of the fibers and improve uniformity of the fibers thereby forming a condensed web;

a rotary outlet cylinder co-operatively arranged to receive the condensed web fibers from the regulator system and constructed to provide the fibers to an airflow the airflow dispersing and projecting the fibers onto a surface to create the fiber web having individual fibers reoriented in all directions.

12. The installation of claim 11 wherein the mechanism disposed at the periphery of the carding cylinder includes a stripper roll and a worker roll.

13. The installation of claim 11 wherein the mechanism disposed at the periphery of the carding cylinder includes static plates with a plurality of carding spikes.

14. The installation of claim 11 wherein the carding cylinder is arranged to rotate in a first direction, wherein the first regulator cylinder is arranged to rotate in a second direction opposite to the first direction, and wherein a periphery of the first regulator cylinder includes spikes pointing in a direction opposite to the second direction.

15. The installation of claim 14 wherein the regulator system further includes a second regulator cylinder disposed on the periphery of the first regulator cylinder and arranged to rotate in the first direction.

16. The installation of claim 15 wherein a periphery of the second regulator cylinder includes spikes pointing in a direction opposite to the first direction.

17. The installation of claim 15 wherein the second regulator cylinder is arranged to rotate at a third circumferential speed that is smaller than the second circumferental speed of the first regulator cylinder.

18. The installation of claim 15 wherein the regulator system further includes a third regulator cylinder, co-operatively arranged with the carding cylinder to take up at least some of the parallel web fibers situated at the periphery of the carding cylinder, and a fourth regulator cylinder disposed on the periphery of the third regulator cylinder, the third regulator cylinder being arranged to rotate in the second direction and the fourth regulator cylinder being arranged to rotate in the first direction.

19. The installation of claim 11 wherein the rotary outlet cylinder is arranged to rotate at an outlet circumferential speed that is greater than the second circumferential speed.

20. The installation of claim 11 wherein the rotary outlet cylinder is arranged to rotate at an outlet circumferential speed that is strictly greater than the first and second circumferential speeds and creates a centrifugal force sufficient for detaching the fibers from a periphery of the rotary outlet cylinder.

21. The installation of claim 20 including a forming and transport surface constructed and arranged to receive the detached fibers and facilitate the reorientation of the fibers under the influence of the airflow.

22. The installation of claim 11 including a blow channel arranged for the airflow to contact a periphery of the rotary outlet cylinder and assists in detaching the fibers from the periphery of said cylinder.

23. The installation of claim 22 including a forming and transport surface constructed and arranged to receive the detached fibers and facilitate the reorientation of the fibers under the influence of the airflow.

24. A method of producing a fiber web by an airlay technique, comprising:

providing a carding system constructed to receive a fiber material and comprising a carding cylinder co-operatively arranged with a mechanism disposed at a periphery of the carding cylinder;

providing a regulator system including a combing cylinder co-operatively arranged with the carding cylinder;

feeding with the fiber material the carding system and providing the fiber material to the carding cylinder rotating at a first circumferential speed;

individualizing and orienting the fibers in parallel to one another by employing the carding cylinder and the mechanism to form a parallel web of fibers;

providing the parallel web of fibers to the combing cylinder of the regulator system while rotating the combing cylinder a second circumferential speed that is smaller than the first circumferental speed of the carding cylinder and thereby reorienting the fibers in the parallel web, controlling a rate of the fibers and improving uniformity of the fibers;

producing a condensed web of fibers by the regulator system;

taking up the fibers of the condensed web issued from the regulator system and bringing the fibers into an airflow by using a rotary outlet cylinder; and forming the fiber web by dispersing and projecting individualized fibers in the airflow onto a forming and transport surface.

25. The method according to claim 24 wherein the taking up the fibers of the condensed web includes rotating the rotary outlet cylinder at an outlet circumferential speed that is higher than that of the second circumferential speed of the combing cylinder.

26. The method according to claim 24 wherein the producing the condensed web of fibers includes employing the combing cylinder having a periphery covered with spikes pointing in a direction opposite to a direction of rotation of the combing cylinder.

27. The method according to claim 24 wherein the producing the condensed web of fibers includes employing the combing cylinder having a periphery covered with teeth pointing in a direction opposite to a direction of rotation of the combing cylinder.

28. The method according to claim 24 wherein the bringing of the fibers into the airflow includes rotating the rotary outlet cylinder at an outlet circumferential speed that is strictly greater than the first and second circumferential speeds and creates a centrifugal force sufficient for detaching the fibers from a periphery of the rotary outlet cylinder.

29. The method according to claim 28 wherein the forming of the condensed web includes employing a forming and transport surface constructed and arranged to receive the detached fibers and facilitate the reorientation of the fibers under the influence of the airflow.

30. The method according to claim 24 wherein the bringing of the fibers into the airflow includes directing the airflow onto a periphery of the rotary outlet cylinder with a blow channel and assisting in detaching the fibers from the periphery of the rotary outlet cylinder with the airflow.

31. The method according to claim 30 wherein the forming of the condensed web includes employing a forming and transport surface constructed and arranged to receive the detached fibers and facilitate the reorientation of the fibers under the influence of the airflow.

* * * * *